US005609467A

United States Patent [19]

Lenhart et al.

[11] Patent Number: 5,609,467

[45] Date of Patent: Mar. 11, 1997

[54] FLOATING INTERTURBINE DUCT ASSEMBLY FOR HIGH TEMPERATURE POWER TURBINE

[75] Inventors: Kenneth J. Lenhart, Cincinnati; Tom D. Stream, Mount Vernon, both of Ohio

[73] Assignee: Cooper Cameron Corporation, Houston, Tex.

[21] Appl. No.: 535,558

[22] Filed: Sep. 28, 1995

[51] Int. Cl.[6] ..... F04D 29/04

[52] U.S. Cl. ..... 415/142

[58] Field of Search ..... 415/142, 182.1, 415/219.1, 220

[56] References Cited

U.S. PATENT DOCUMENTS

| | | | |
|---|---|---|---|
| 2,962,256 | 11/1960 | Bishop | 415/219.1 |
| 2,964,972 | 12/1960 | Lindsey et al. | 415/219.1 |
| 3,398,535 | 8/1968 | Campbell et al. | 415/142 |
| 4,260,326 | 4/1981 | Scott et al. | 415/200 |
| 4,470,754 | 9/1984 | Manente et al. . | |
| 4,565,492 | 1/1986 | Bart et al. . | |
| 4,566,850 | 1/1986 | Grzina . | |
| 4,643,638 | 2/1987 | Laurello . | |
| 4,759,687 | 7/1988 | Miraucourt et al. . | |
| 4,889,469 | 12/1989 | Wilkinson . | |
| 4,890,978 | 1/1990 | McLaurin et al. . | |
| 5,080,555 | 1/1992 | Kempinger | 415/142 |
| 5,180,282 | 1/1993 | Lenhart et al. . | |
| 5,236,303 | 8/1993 | Fowler et al. . | |
| 5,275,529 | 1/1994 | Langenbrunner et al. | 415/119 |
| 5,292,227 | 3/1994 | Czachor et al. | 415/142 |
| 5,295,787 | 3/1994 | Leonard et al. . | |
| 5,312,227 | 5/1994 | Grateau et al. | 415/142 |

*Primary Examiner*—John T. Kwon

*Attorney, Agent, or Firm*—Laff, Whitesel, Conte & Saret, Ltd.

[57] ABSTRACT

A floating interturbine duct assembly for a high temperature power turbine, including means for automatically adjusting to accept thermal expansion movement between dissimilar materials.

11 Claims, 8 Drawing Sheets

FLOATING INTERTURBINE DUCT ASSEMBLY FOR HIGH TEMPERATURE POWER TURBINE

FIELD OF THE INVENTION

This invention relates to gas turbine engines. More particularly, this invention relates to an interturbine duct or turbine exhaust duct assembly for use on a high efficiency gas turbine engine.

BACKGROUND OF THE INVENTION

Gas turbine engines are used for generating power for a multiplicity of applications, among others, the production and transmission of oil and gas. Such engines typically consist of an aero-derivative gas generator and a mechanically uncoupled, free driven power turbine. A drive shaft connects the power turbine to a work-load, as examples, a pipeline compressor or a power generation unit. The gas generator and the power turbine are not mechanically connected by a shaft. Instead, the mating connection between these two parts of the engine is a flowpath duct forming an outer structural casing, as described in greater detail below.

The aforementioned flowpath duct is aerodynamically designed and co-axially spans the axially disposed space between the gas generator turbine exit and the power turbine inlet.

Basically, this flowpath duct can experience temperatures slightly above 1400 degrees Fahrenheit for industrial use, but, in the near future, might even be exposed to temperatures as high as 1650 degrees Fahrenheit. These higher engine temperatures are necessary to achieve increased horsepower and higher thermal efficiencies. In addition, the gas turbine equipment used with the higher engine temperatures must be highly durable and have a long component life to eliminate the high costs associated with equipment down time and/or replacement.

However, such demands for higher power, higher efficiency, and greater durability usually result in difficult component design material specifications. For example, in the case of the interturbine flowpath duct, the previously mentioned hot flowpath temperatures may require cooling air to prevent the metal temperatures from exceeding design parameters. Moreover, as the cooling air requirement increases, the performance or efficiency of the engine diminishes. Thus, a high efficiency engine requires an interturbine duct that is not only durable but also which prevents excessive cooling air leakage.

There are presently several known interturbine and turbine exhaust ducts which generally consist of one of two basic designs. The first design, not shown, involves three main elements or components: a 360 degree inner annulus; a 360 degree outer annulus; and a multiplicity of equally spaced flowpath struts rigidly connecting the two annuli. While this design minimizes cooling fluid leakage through the duct into the flowpath, it has proven to be not very durable. In actual operation, the inner annulus, the outer annulus, and the connecting struts are at different temperatures which causes a disparity in thermal expansion among these three elements, resulting in high thermal stresses, premature fatigue cracking, and excessive duct distortion. In addition, there are often early, unplanned engine down time for repair or replacement of the duct.

A second design, also not shown, is a flowpath duct which is axially split into equal circumferential segments, with each segment having one strut and a portion of the inner and outer annuli on each side. While this design addresses and minimizes the thermal stress and distortion problems associated with the aforementioned 360 degree duct and further significantly improves the life and durability of the part, there are problems associated with its use. For example, gaps ensue between the segments which results in a considerable area for cooling air to leak into the hot flowpath. This remains the case even with strip seals inserted between segments.

OBJECTS OF THE PRESENT INVENTION

An object of this invention is to provide an interturbine duct or turbine exhaust duct which eliminates high thermal stresses that lead to premature low cycle fatigue cracking, or excessive creep distortion. It is another object of the present invention to provide an interturbine duct or turbine exhaust duct which eliminates excessive cooling air leakage which would have an adverse effect on overall gas turbine efficiency and performance.

Thus, the present invention provides a new, low stressed, low leakage interturbine duct assembly for use on a new, high efficiency gas turbine engine for a multiplicity of power applications. The inventive interturbine duct assembly, illustrated herein, increases engine performance due to reduced cooling air leakage, increases the life and durability of the duct due to lower stress, lowers the potential warranty cost, and minimizes the engine down time.

Other objects and advantages of the invention will appear hereinafter.

DETAILED SPECIFICATION

Figure 1:
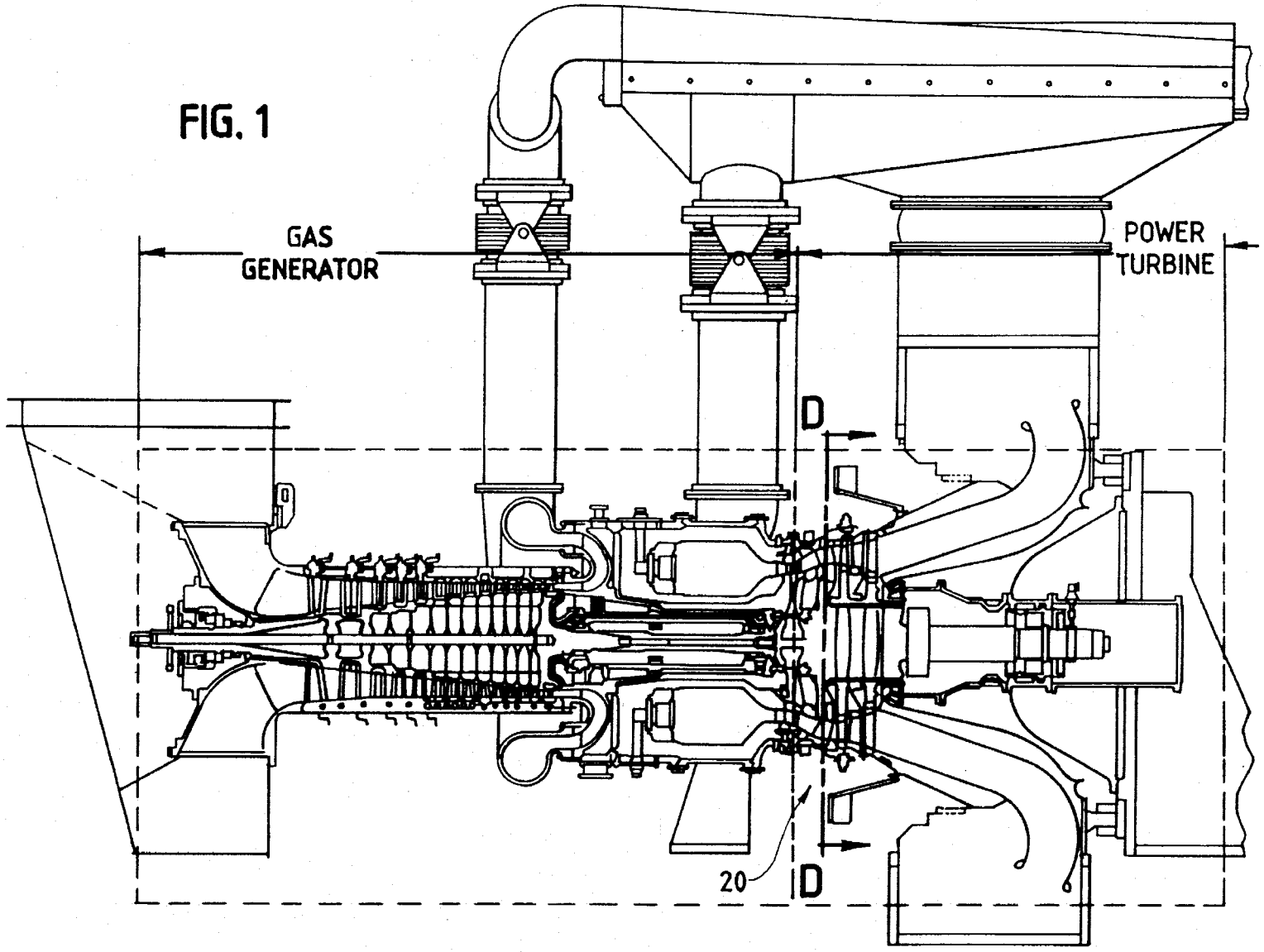
FIG. 1 is a generalized schematic in partial section of an elevational view of a gas generator and power turbine interconnected by means of one embodiment of the present ductwork invention.
Figure 2:
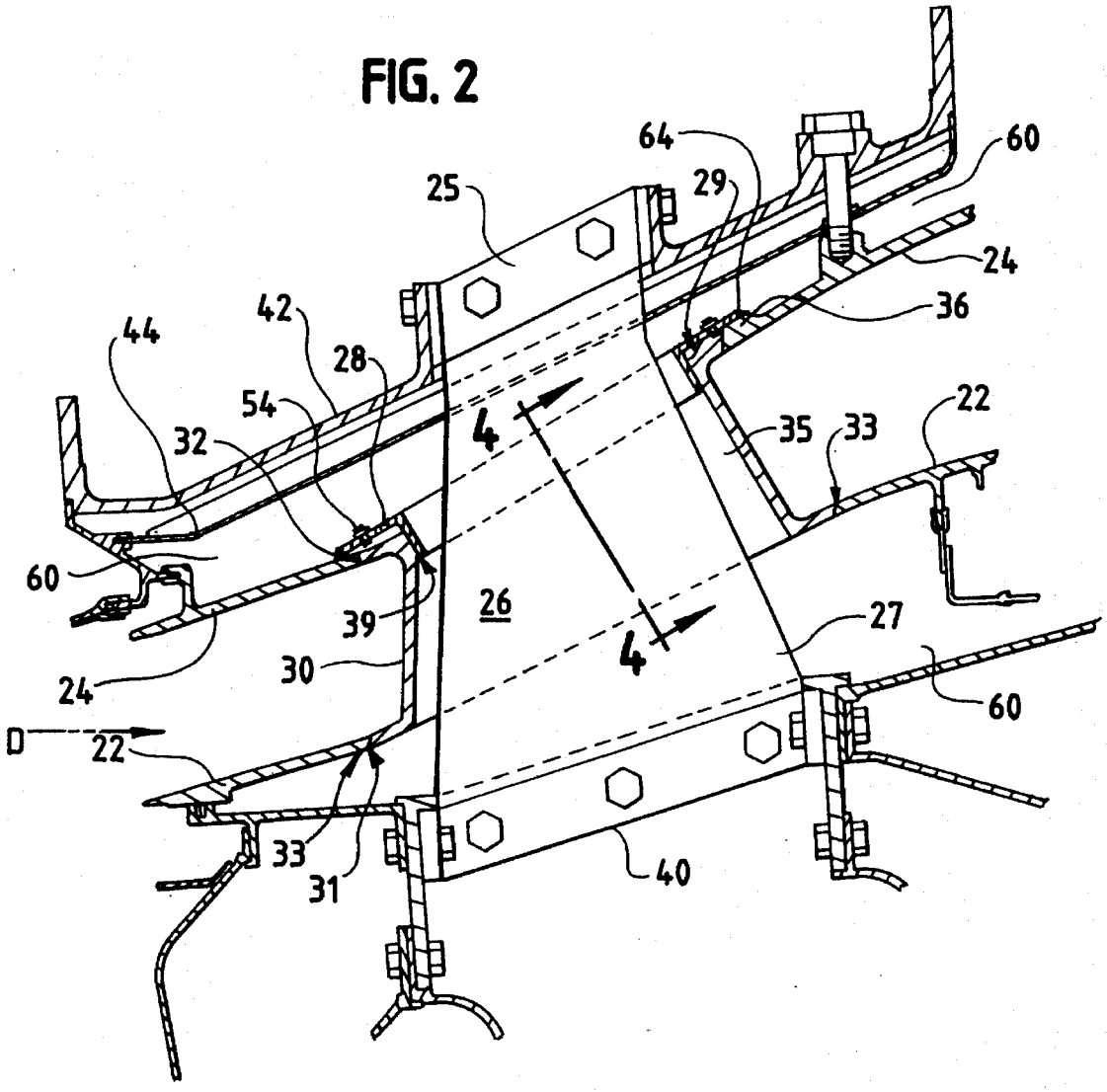
FIG. 2 is an elevational view in partial section of a segment of the preferred embodiment of the present invention generally found along line D—D of FIG. 1, showing a foreshortened radial strut enclosed within a strut fairing, a floating interturbine ductwork, and support means.
Figure 3:
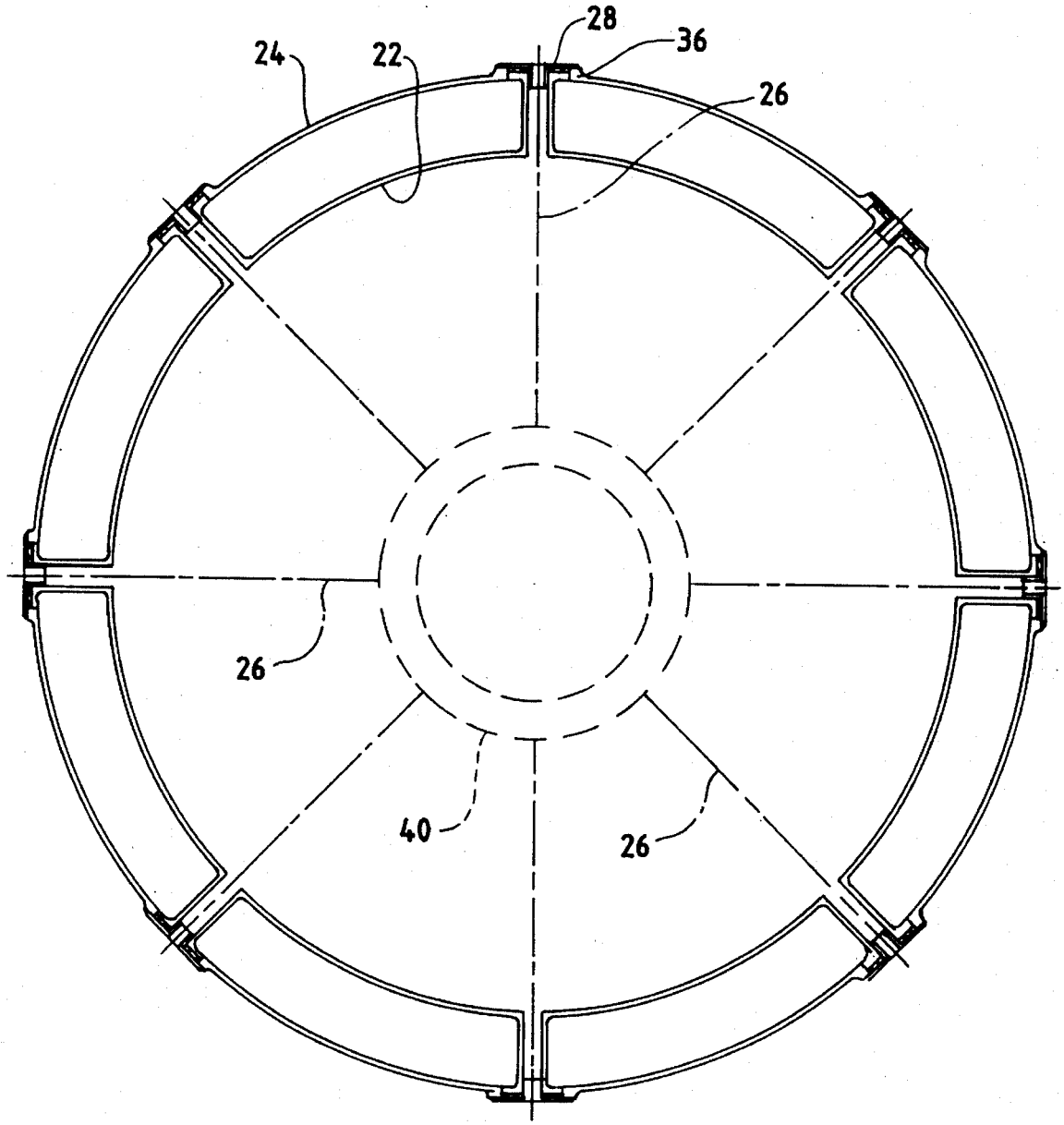
FIG. 3 is a schematic axial view taken generally along line D from the left end of FIG. 2, and representing an axial section of the duct taken on struts and their surrounding fairings, the details being shown in more detail in the other drawings.
Figure 4:
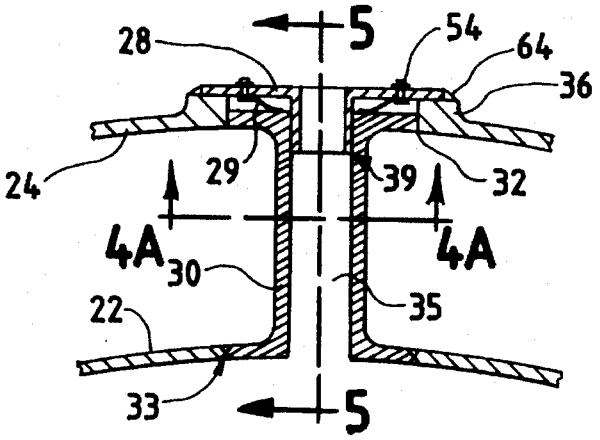
FIG. 4 is an elevational view in transverse section of a typical strut fairing, its end cap, and a partial sectional view of the ductwork, taken along line 4—4 in FIG. 2.
Figure 4A:
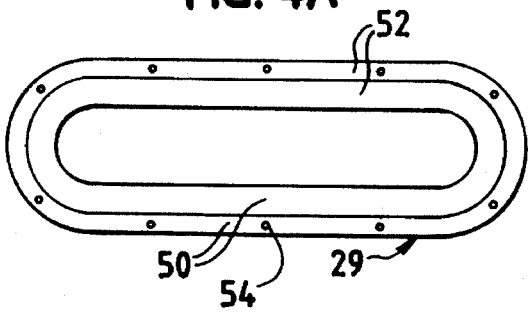
FIG. 4A is a plan view of the underside of the metallic spring affixed to the underside of the end caps.

Referring now to the drawings wherein similar parts are identified by similar numerals, this invention relates to a new, floating interturbine duct design that is generally in the form of a frusto-conical casing between a gas generator and a power turbine. The duct is generally indicated by the numeral 20. It addresses both problems of high thermal stress as well as minimum cooling air leakage. Referring to FIG. 2, the floating interturbine duct 20 includes an inner flowpath annulus 22 and a spaced outer flowpath annulus 24. A plurality of radial struts 26 each pass through a strut fairing 30 extending between the inner and outer annuli. The struts 26 are fastened at their inner end 27 to a hub structure 40 and at their opposite or outer end 25 to an outer ring assembly 42, as seen in the schematic FIG. 3. These latter arrangements are illustrated merely to place the invention in the environment in which it is used, notwithstanding the fact that the strut is only shown in FIG. 2 and schematically in FIG. 3 but should be understood to exist within each fairing 30 and metal resilient seal end cap 28.

Strut fairing 30, fairing end caps 28 and split flexible metal seals 29 in combination with special aperture configurations 31 and 32 in both the inner annulus and the outer annulus are the novel configuration of the present invention.

Figure 7:
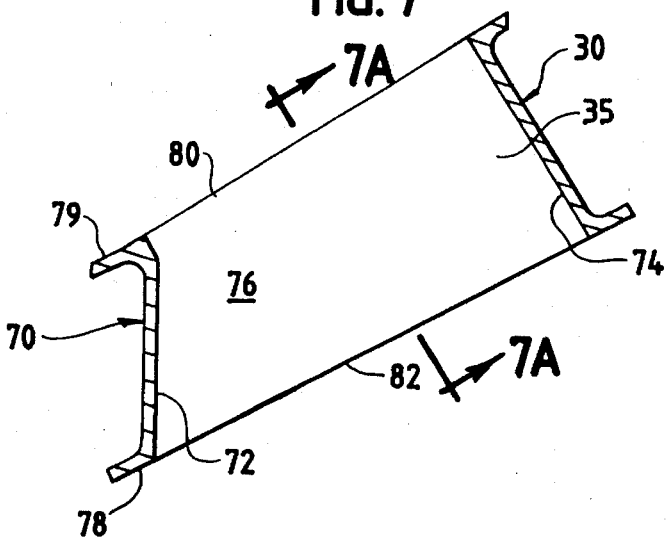
FIG. 7 is a sectional elevational view of the preferred strut fairing of the present invention, as taken along line 7—7 in FIG. 7B.
Figure 7A:
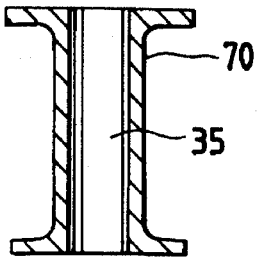
FIG. 7A is a sectional elevational view of the strut fairing taken along line 7A—7A in FIG. 7.
Figure 7B:
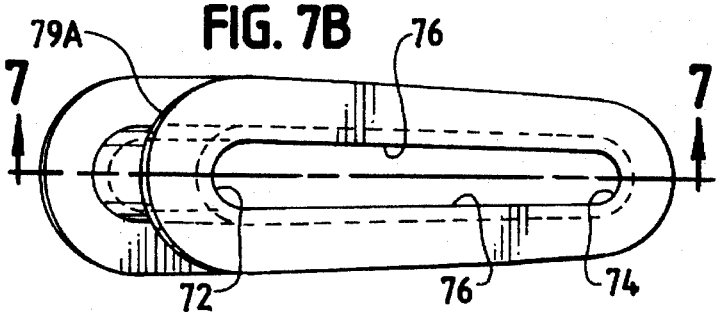
FIG. 7B is a top plan view of the strut fairing utilized in the present invention.
Figure 7C:
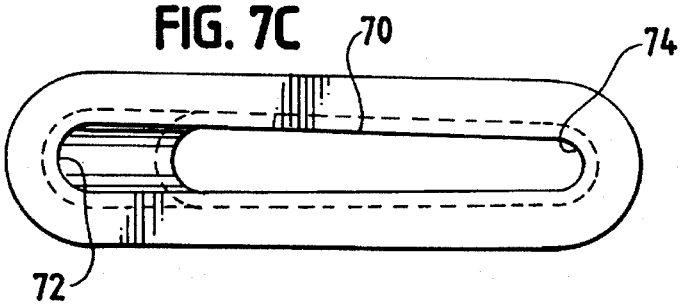
FIG. 7C is a bottom plan view of the strut fairing utilized in the present invention.

Referring to FIGS. 7–7C we can see the strut fairing 30, which includes a tapered oval hollow body portion 70 having a pass through passage 35 capable of accommodating a structural strut 26. Passage 35 is tapered axially as well as transversely as evidenced by the enlarged circular end surface 72 and a reduced circular end 74 interconnected by a pair of substantially straight connecting side walls 76. At the upper end 80 there is a laterally extending flange 79 having a chamfered edge 79A for purposes best described hereinafter. At the lower end 82 there also is a lower flange 78 extending around the fairing.

Figure 6:
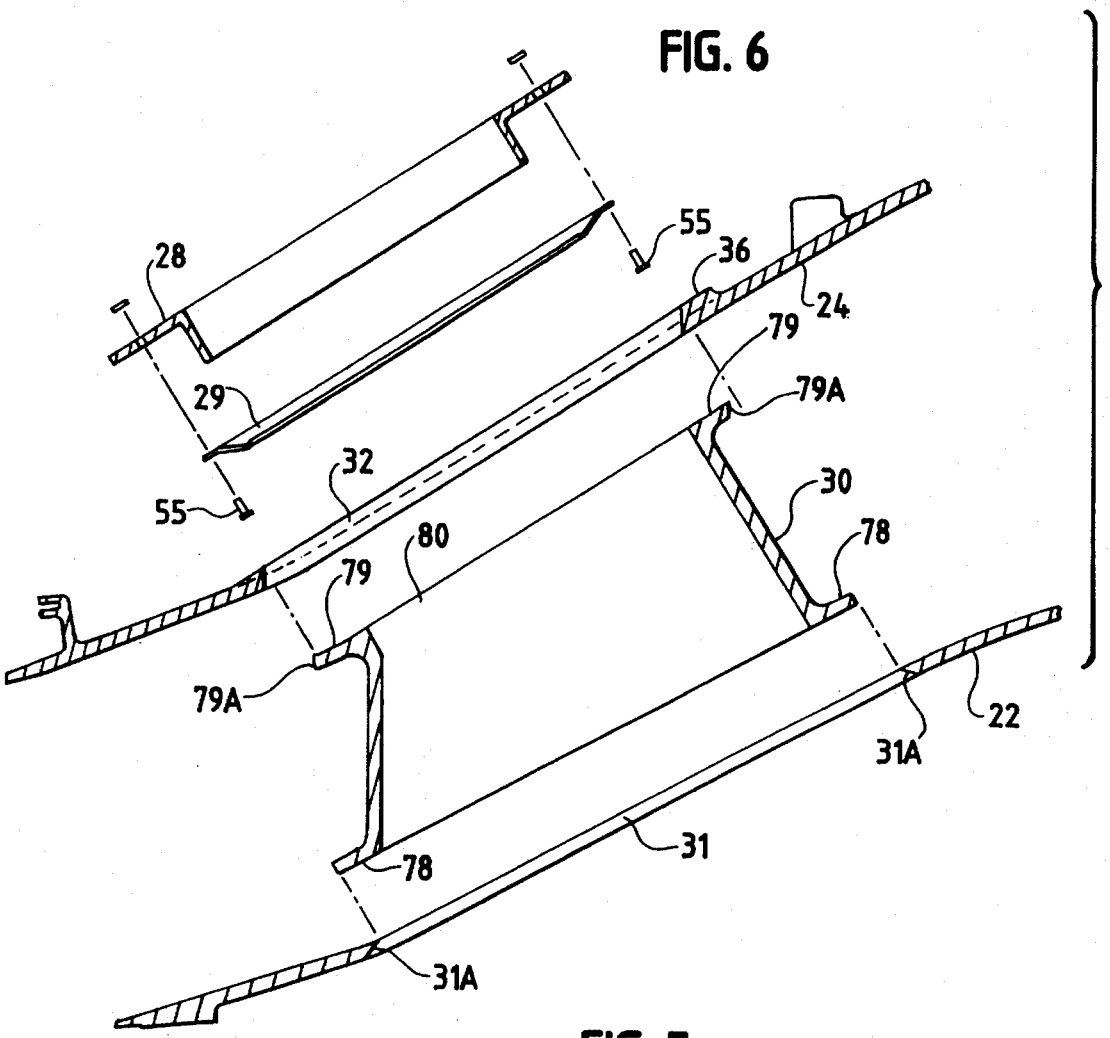
FIG. 6 is an exploded view of the elements seen assembled in FIG. 5.
Figure 8:
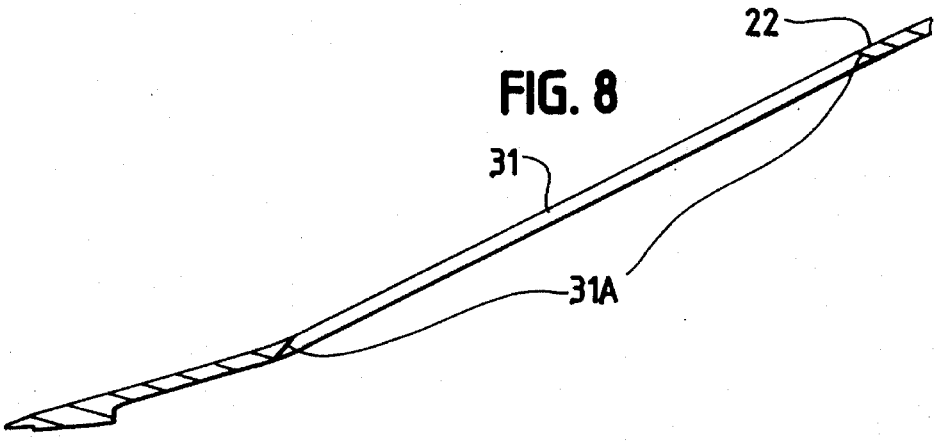
FIG. 8 is a partial cross-sectional view of the aperture in the inner flowpath annulus for accepting the strut fairing, as taken along line 8—8 of FIG. 8A.
Figure 8A:
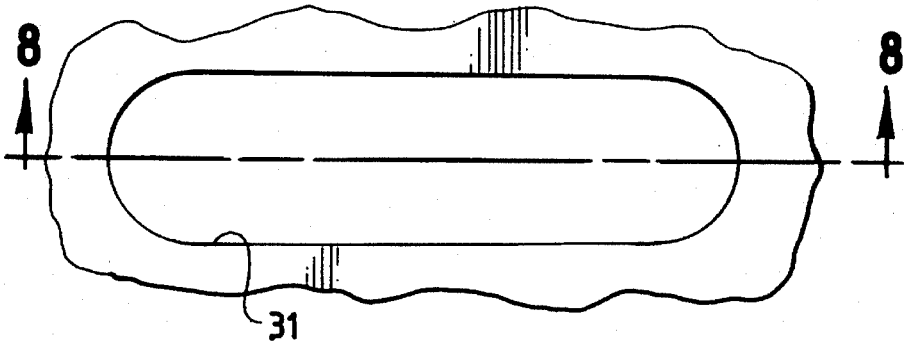
FIG. 8A is a plan view of the designed aperture in the inner flowpath annulus for accepting the strut fairing.

The inner annulus 22 and the outer annulus 24 are fixtured such as to allow the insertion of the strut fairing 30 from the bottom through shaped holes or slots 31 and 32 in both annuli. The oval slot 31 in inner annulus 22 is chamfered as at 31A, as best seen in FIGS. 6 and 8, to provide a slot or pocket when flange 78 is telescoped into the hole so that there is a relief to accept the weld 33 joining the lower end of fairing 30 to inner annulus 22.

Figure 9:
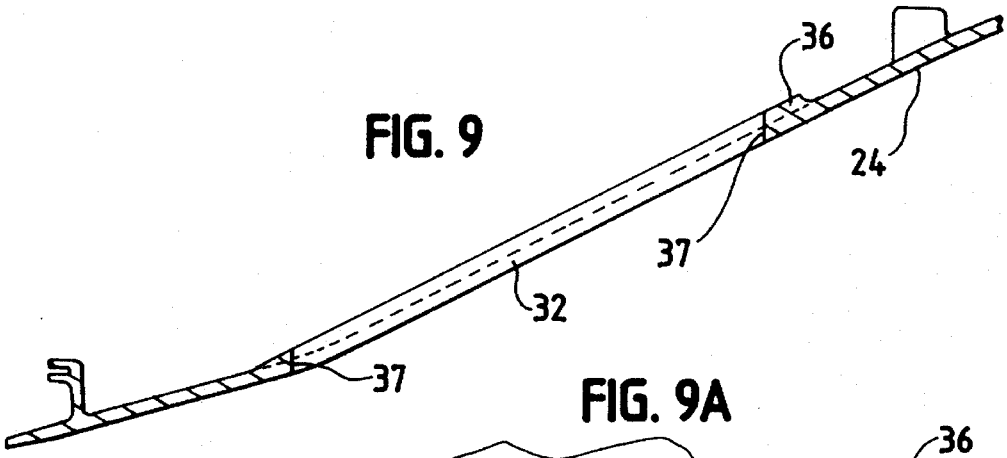
FIG. 9 is a partial cross-sectional view of the aperture in the outer flowpath annulus for accepting the strut fairing, as taken along line 9—9 of FIG. 9A.
Figure 9A:
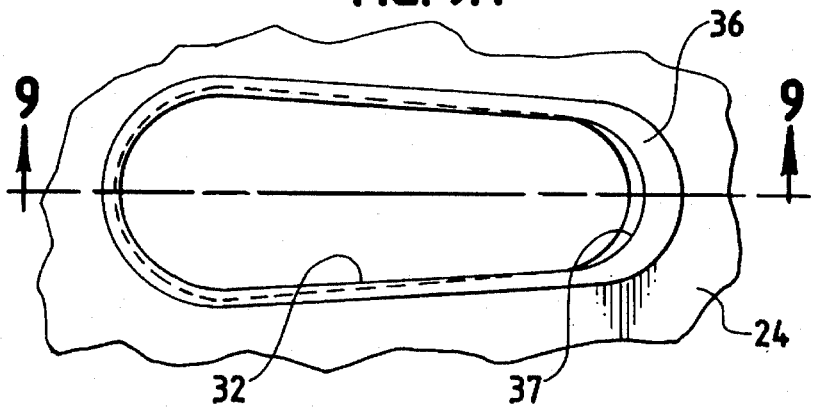
FIG. 9A plan view of the aperture in the outer flowpath annulus for accepting the strut fairing.
Figure 10:
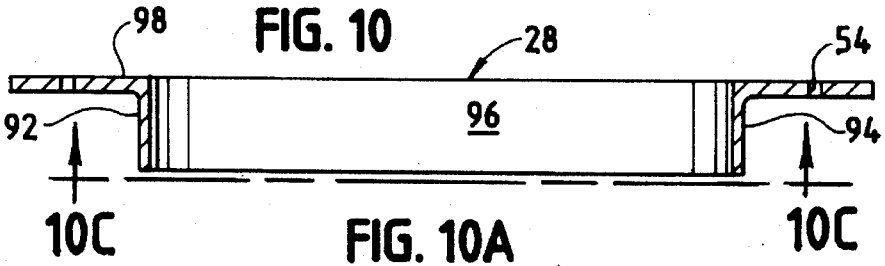
FIG. 10 is an elevational view in section of an end cap forming a portion of this invention, as taken along line 10—10 in FIG. 10A.
Figure 10A:
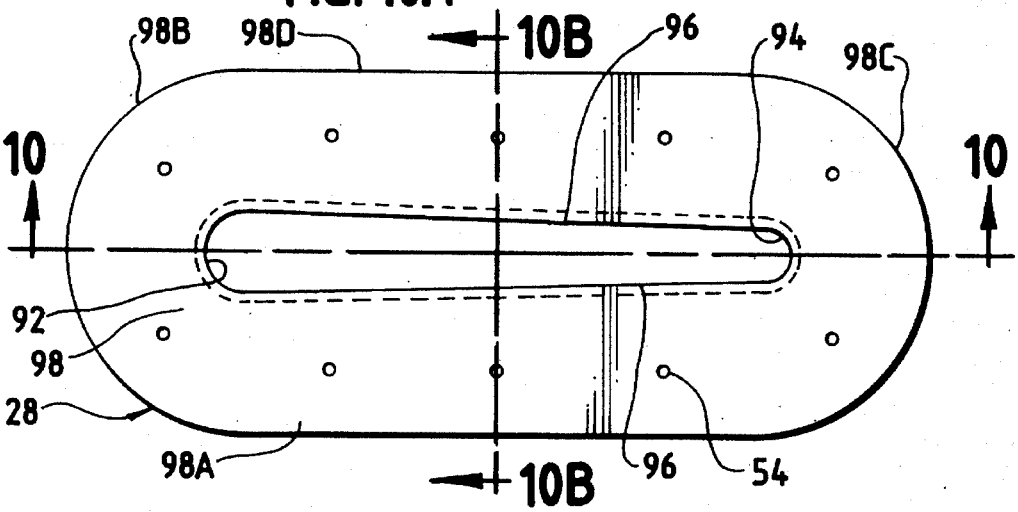
FIG. 10A is a topside plan view of the end cap shown in FIG. 10.
Figure 10B:
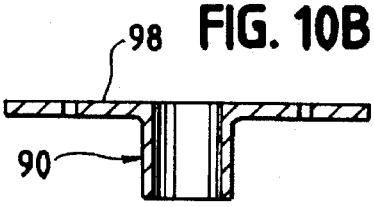
FIG. 10B is a transverse sectional view of an end cap, as taken along line 10B—10B in FIG. 10A.
Figure 10C:
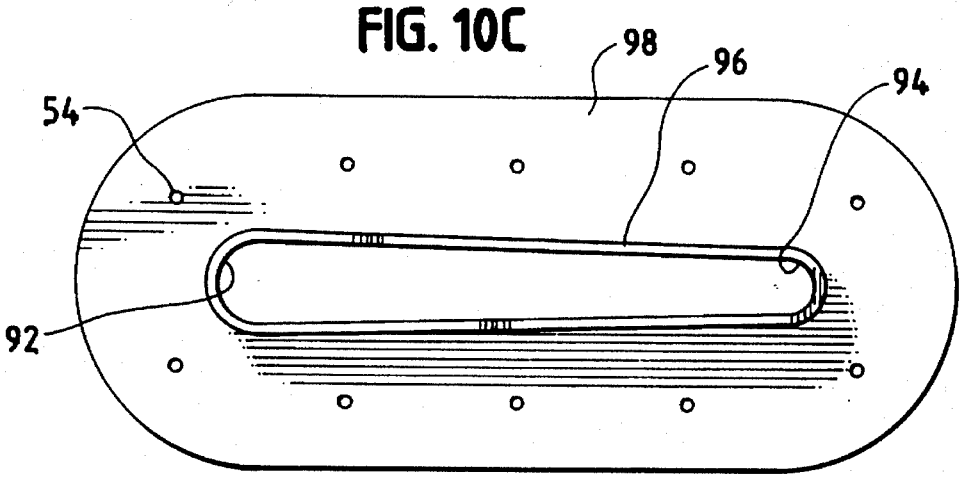
FIG. 10C is a reduced underside plan view of the fairing end cap taken along line 10C—10C.
Figure 11:
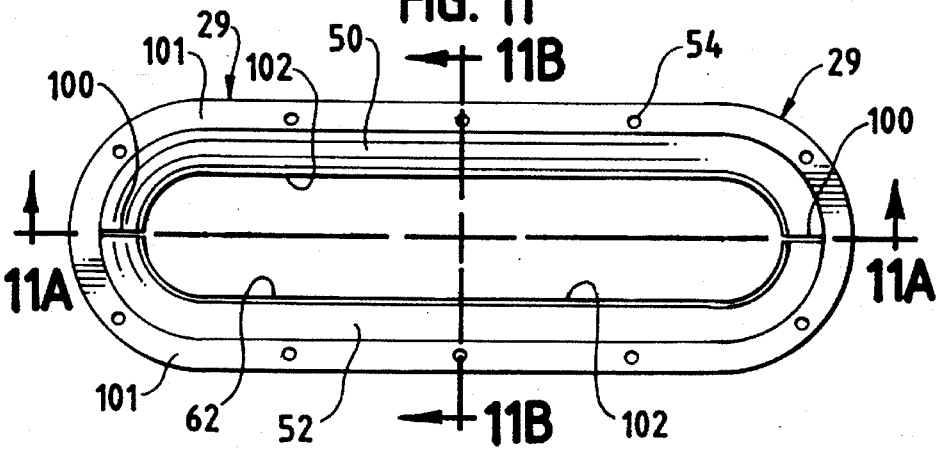
FIG. 11 is a plan view of the metallic spring member to be assembled with the end cap of FIG. 10.
Figure 11A:
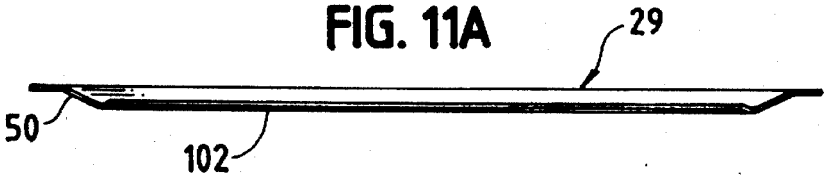
FIGS. 11A and 11B are a side elevational sectional view taken along line 11A—11A and a transverse sectional view taken along line 11B—11B as seen in FIG. 11.
Figure 11B:
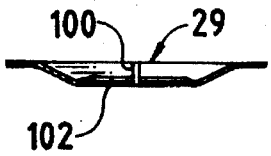

While each fairing 30 is securely welded as at 33 to the inner annulus 22, the opposite or upper end 80 with its chamfered edge 79A of flange 79 is allowed to axially slide relative to the shaped edge 37 of slot 32 in the outer annulus 24, with a gap all around for freedom of movement, the gap being on the order of 0.01–0.02 inch as best seen in FIGS. 9 and 9A. A ridge-like rim or abutment 36 surrounds the outer side of slot 32 and provides continuation of chamfered side surface 37 for engagement by chamfered edge 79A of fairing flange 70 as it slides under thermal expansion.

Next, the fairing end cap 28 with integrally attached flexible metal seal 29 is inserted into upper end 80 of the hollow fairing opening 35. The end cap 28 and seal 29, as best seen in FIGS. 2, 4, 6, 10 and 11, includes a drawn metal open oval cup-like body 90 having an enlarged semi-circular end 92 and a smaller semi-circular end 94 interconnected by substantially flat side walls 96. Extending radially outwardly from one end of body 90 is a continuous head 98 having a pair of rounded ends 98B and 98C interconnected by the straight sides 98A and 98D. The radial extent of head 98 is substantially greater than the upper end flange 79 of fairing 30. A plurality of apertures 54 are equally spaced around the head 98 to accept fastening means such as the rivets 55 for securing the seal 29.

The oval metal seal 29 is struck from flat sheet metal to form a flat oval head 101 having semi-circular ends and generally flat side portions. The head 101 is provided a number of apertures 54 equal to the apertures 54 in the end cap head. An integral inwardly depending resilient skirt having a coined or otherwise worked edge to provide a smooth surface is split as at 100 in the middle of the circular end portions to assist in relieving the hoop strength normally encountered in circular flexed coined members. This provides two halves 50 and 52 that, along with the head portion, is secured to the underside of the end cap 28 with rivets 55, welding, or some suitable fastening method.

Figure 5:
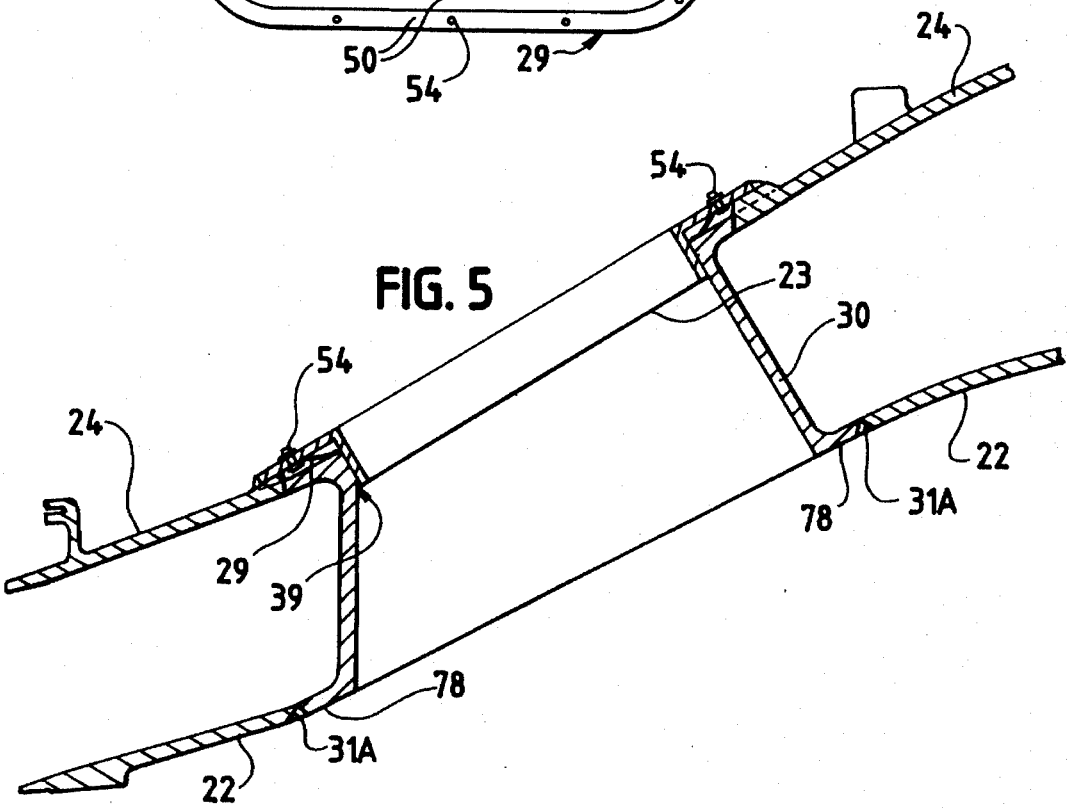
FIG. 5 is an elevational sectional view generally axially disposed and taken along line 5—5 of FIG. 4.

As shown in FIGS. 2 and 5, the metal seal 29 is depressed/compressed against the top of the fairing 30 as the end cap 28 is inserted. A 0.005–0.010 inch gap 39 exists all around between the inside wall of fairing 30 and end cap 28, prior to inserting end cap 28 into opening 35 of fairing 30.

As was mentioned above, aperture 31 in the inner annulus 22 is chamfered as at 32 to readily accept the chamfered lower flange 78 of fairing 30 and provide a recess to accommodate the welding bead 33.

The upper surface, as seen in the drawing, of FIGS. 2, 6, and 9, of the outer annulus 24 includes an elevated rim 36 surrounding aperture 32 with the inner wall 37 forming the aperture being chamfered to accept thermally induced axial movement of the fairing 30 and the inner annulus 22 relative to the outer annulus 24. Each end cap 28 is then welded 64 to the reinforcement rim 36 around each shaped hole or slot 32 in outer annulus 24 to seal and close each fairing end.

The multiple piece resilient metallic seal 29, having at least two parts 50–52, are preferably coined or otherwise worked to provide a smooth edge 102 to induce a lubricious joint regardless of temperature. The fairing 30 is aerodynamically designed to permit smooth flow of hot gases around the strut 26. A cooling cavity 60 has as one wall annulus 24 and an upper wall 44. Cooling medium can freely pass from the cooling cavity through the fairing 30 hollow opening 35 into the voids on opposite sides of the duct formed by annuli 22 and 24 without significant leakage of the cooling medium into the hot flowpath.

Thus, the interturbine duct is now an integral 360 degree assembly allowing the inner annulus 22 and the strut fairings 30 to thermally grow relative to and independent of the outer annulus 24. The flexible metal spring loaded seal 29 prevents significant leakage of cooling air into the hot flowpath while preventing/minimizing hot flowpath gas ingestion into the hollow strut fairing cavity 35. The welded end cap 28 to outer annulus 24 prevents any leakage of outer annulus cavity cooling 60 into the flowpath around the strut fairings 30.

We claim:

1. A floating duct system for conveying high temperature fluid medium between a gas generator and a power turbine including an outer annular ring, an inner annular ring, a hollow strut fairing extending between said annular rings, an end cap having sealing means for maintaining a substantial fluid medium seal between said strut fairing and said outer annular ring.

2. A floating duct system as claimed in claim 1 wherein said end cap includes an axially extending hollow body complimentary to the interior of said hollow strut fairing, a laterally extending head at one end of said body, sealing means carried on the underside of said head and adapted to resiliently engage one end of said fairing.

3. A floating duct system as claimed in claim 2 wherein said annular rings are substantially 360 degrees and radially spaced a predetermined distance, each ring having an equal number of a plurality of circumferentially spaced apertures radially aligned with an aperture of its opposed ring, one said hollow strut fairing extending between each pair of opposed apertures and having a length substantially equal to said predetermined distance, each said hollow strut fairing having a laterally outwardly extending flange at opposite ends, one end flange of said fairing being affixed to the marginal material of a said aperture in one of said annular rings, the opposite end flange of said one hollow strut fairing having a complimentary sliding engagement with the margin of said radially opposite aperture of the other annular ring to accommodate dissimilar thermal expansion between the various parts.

4. A floating duct system as claimed in claim 3 wherein said radially opposite aperture in said other annular ring includes an axially disposed enlargement surrounding a substantial portion of said aperture margin to provide a mating sliding engagement with said opposite end flange of said fairing.

5. A floating duct system as claimed in claim 4 wherein said laterally extending head of each said end cap is secured to said adjacent enlargement and said resilient sealing means extends into said aperture to engage said opposite end flange of said fairing, thereby preventing egress of hot fluid medium from around each said fairing as well as preventing ingress of cooling medium.

6. A flow path duct system extending between a gas generator and a gas turbine and designed to carry a high temperature, high energy gas stream from said gas generator, a plurality of circumferentially spaced radially disposed strut means normally extending between hub means and radially spaced frame structure carrying the turbine loads, said system being designed to protect and maintain said structure made of high strength structural material at a reduced thermal environment by placing said flow path duct system around the strut of said structure, said flow path duct system including a plurality of intermittent hollow strut fairings equal in number to the number of struts, an outer flow path wall and an inner flow path wall, said fairings surrounding said struts and extending between said walls, said fairings rigidly connected at one end to one of said flow path walls and means including an end cap with a resilient seal means at the opposite end of said fairing to cooperate with said opposite flow path wall and said fairing to accommodate differentials in thermal expansion between said walls and said fairing.

7. A flow path duct system as claimed in claim 6 wherein each said hollow fairing includes a laterally extending flange at each opposite end, one of said flanges including a flat exposed upper surface and an exposed marginal surface complimentary to the wall defining said aperture in said opposite flow path wall so that said fairing can slide axially within the side wall forming said aperture.

8. A flow path duct system claimed in claim 7 wherein each aperture in said opposite flow path wall includes an axially extending enlargement having an extension of said internal surface forming said aperture that is complimentary to said exposed marginal surface of said fairing flange whereby said flange can slide axially upon thermal expansion a distance greater than the normal thickness of said opposite flow path wall.

9. A flow path duct system claimed in claim 8 wherein said system includes an end cap having a hollow body complimentarily accepted within the axial opening in said fairing and accommodates the strut extending therethrough, said hollow body having a laterally extending flanged head, said head engaging and being secured to the upper extremity of said enlargement.

10. A flow path duct system claimed in claim 9 wherein said head is fixedly secure to said enlargement, said head supporting a resilient sealing member extending downwardly therefrom and acting on the said flat exposed upper surface of the fairing flange and capable of accepting by flexing any axial movement of said fairing flange caused by thermal expansion.

11. A flow path duct system claimed in claim 10 wherein said resilient sealing member includes a flat portion secured to the underside of said head and a resilient angularly depending resilient leg that engages said fairing flange flat surface, said sealing member being split to relieve hoop strength in said resilient leg when depressed.

* * * * *